US006524022B2

(12) United States Patent
Minowa et al.

(10) Patent No.: US 6,524,022 B2
(45) Date of Patent: Feb. 25, 2003

(54) RECORDING PAPER CUTTER AND PRINTER THEREWITH

(75) Inventors: Masahiro Minowa, Matsumoto (JP); Naoki Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 20 days.

(21) Appl. No.: 09/750,237

(22) Filed: Dec. 26, 2000

(65) Prior Publication Data

US 2001/0013529 A1 Aug. 16, 2001

(30) Foreign Application Priority Data

Jan. 31, 2000 (JP) ..... 2000-022897

(51) Int. Cl.[7] ..... B41J 11/70; B41J 11/66; B41J 15/04

(52) U.S. Cl. ..... 400/621; 225/1; 225/77; 225/91; 225/90; 400/613

(58) Field of Search ..... 400/621, 613; 225/91, 39, 42, 77, 15, 26, 53, 90; 224/4, 5

(56) References Cited

U.S. PATENT DOCUMENTS 4,579,267 A * 4/1986 Planke ..... 225/19
4,951,858 A * 8/1990 Krall ..... 225/19
5,407,115 A 4/1995 Blalock et al. ..... 225/1
6,173,876 B1 * 1/2001 Sano et al. ..... 225/39

FOREIGN PATENT DOCUMENTS

DE 3516912 A1 * 11/1985 ..... B41J/11/70
EP 435723 A1 * 7/1991 ..... B26D/7/08
JP 63072568 A * 4/1988 ..... B41J/11/66

* cited by examiner

*Primary Examiner*—Daniel J. Colilla
(74) *Attorney, Agent, or Firm*—Hogan & Hartson, LLP

(57) ABSTRACT

A paper cutter includes a blade extending in the width of a rolled paper, the blade having a linear edge and a serrated edge formed at an end of the linear edge. A paper guide for discharging the paper is disposed downstream from the cutter, the paper guide having an upper and a lower member and a discharge port at the downstream end thereof. A cutout section is formed at the upper member of the paper guide, and the position of the cutout section corresponds to the serrated blade edge in the width direction of the paper. The cutout section permits the paper to be grasped with fingers by the operator. When the paper is pulled, a force acts on the paper in a direction to press it against the serrated blade edge, cutting the paper from the edge.

14 Claims, 5 Drawing Sheets

RECORDING PAPER CUTTER AND PRINTER THEREWITH

BACKGROUND OF THE INVENTION

1. Field of the Invention

The present invention relates to a recording paper cutter, which may be assembled in a receipt-issuing machine mounted on a point-of-sale (POS) terminal for cutting a receipt issued thereby to a predetermined length, and the like, and relates to a recording apparatus including the cutter.

2. Description of the Related Art

A recording paper cutter is known from, for example, U.S. Pat. No. 5,407,115. The receipt cutter disclosed in this United States patent includes a beaked recording paper guide for guiding a printed roll paper up to a discharge port, and further includes an angled cutting blade having an apex at the center thereof in the width direction of a roll paper, the cutting blade located upstream of the recording paper guide in the feeding direction of the roll paper.

The printed roll paper is fed to the recording paper guide, passes the cutting blade with the direction of curl facing the cutting blade, and is discharged from the discharge port defined by the extreme end of the recording paper guide. The feeding of the roll paper is stopped when the paper protrudes from the discharge port by a certain length. When a person receiving a receipt grasps the extreme end of the roll paper discharged from the discharge port with the fingers and pulls it strongly toward him or her, the roll paper is cut at a right angle in the width direction thereof with the center of the angle cutting blade as the starting point of the cut. The receipt cutter can be simply arranged as described above, and moreover, the roll paper can be cut cleanly by a simple operation of pulling the end of the discharged roll paper.

SUMMARY OF THE INVENTION

An object of the present invention is to provide a recording paper cutter capable of cutting a recording roll paper discharged from a discharge port defined at the extreme end of a recording paper guide by pulling the paper toward an operator with less of an operating force.

To achieve this, a recording paper cutter of the present invention includes a recording paper guide for guiding an elongated recording paper; a recording paper cutting blade disposed upstream of the recording paper guide in the feed direction of the recording paper and having a linear blade edge and a serrated blade edge formed at least at an end of the linear blade edge in the width direction of the recording paper; and a discharge port formed on the downstream side of the recording paper guide in the feed direction of the recording paper, wherein at least one end of the discharge port in the feed direction of the recording paper is arranged to expose the recording paper discharged, and the discharge port has a cutout section, by which the recording paper may be grasped, on a side corresponding to the serrated blade edge.

When the serrated blade edges are formed on both ends of the linear blade edge in the width direction of the recording paper, the cutout sections may be formed at positions, which correspond to the respective serrated blade edges, of the opening edge of the recording paper guide at the extreme end thereof.

In the recording paper cutter of this arrangement, the elongated recording paper such as a roll paper and the like is guided by the recording paper guide and reaches the discharge port thereof. When the feeding of the recording paper is stopped, only the portion which corresponds to the cutout section of the extreme end portion of the recording paper can be grasped by the fingers of an operator or the like. When the extreme end portion of the recording paper is held by the operator and is pulled toward the operator, the portion of the recording paper facing the cutting blade is pressed against the serrated blade edge which is formed on the same side in the width direction of the recording paper, and recording paper is cut in its width direction with that portion as the starting point. An edge of the recording paper can be very simply cut by the serrated blade edge, which permits the recording paper to be simply cut by a small operating force.

When the cutout sections are formed on both the sides of the discharge port at the extreme end of the recording sheet guide, an edge of the recording paper is cut first even if a portion of the end of the recording paper exposed from the cutout sections by the serrated blade edge of the cutting blade and the recording paper is cleanly cut with the edge as a starting point.

The discharge port of the recording paper cutter of the present invention may be composed of a lower guide member and an upper guide member and the cutout section may be formed at at least the upper guide member.

The discharge port may include the cutout sections formed at both the upper and lower guide members at positions opposing each other.

A printer of the present invention includes a print mechanism unit; a cabinet; a recording paper guide for guiding a recording paper to the outside of the cabinet; and a recording paper cutter having a recording paper cutting blade, wherein the recording paper cutting blade is disposed upstream in the feeding direction of the recording paper and has a linear blade edge and a serrated blade edge formed at least at an end of the linear blade edge in the width direction of the recording paper, the recording paper guide has a discharge port at the extreme end thereof, and the discharge port has a cutout section on the side thereof which corresponds to at least the serrated blade edge so that the recording paper can be easily cut.

A printer of the present invention includes an accommodating unit for accommodating a paper roll; a print unit for printing the paper pulled out from the accommodating unit; a feeding unit for feeding the paper printed by the print unit toward a discharge port by a predetermined length; a guide unit interposed between the feeding unit and the discharge port for guiding the paper at both surfaces thereof; and a cutter interposed between the guide unit and the feeding unit for cutting the printed paper, wherein a cutout section, through which the printed paper is held, is formed at least at one surface of the guide unit in the vicinity of the discharge port.

The cutter may include a serrated blade edge on the side thereof which corresponds to the cutout section formed at the discharge port.

It is to be understood that both the foregoing general description and the following detailed description are exemplary and explanatory and are intended to provide further explanation of the invention as claimed.

DETAILED DESCRIPTION OF THE PREFERRED EMBODIMENTS

Recording paper cutters according to embodiments of the present invention will be described below with reference to the accompanying drawings.

Figure 1:
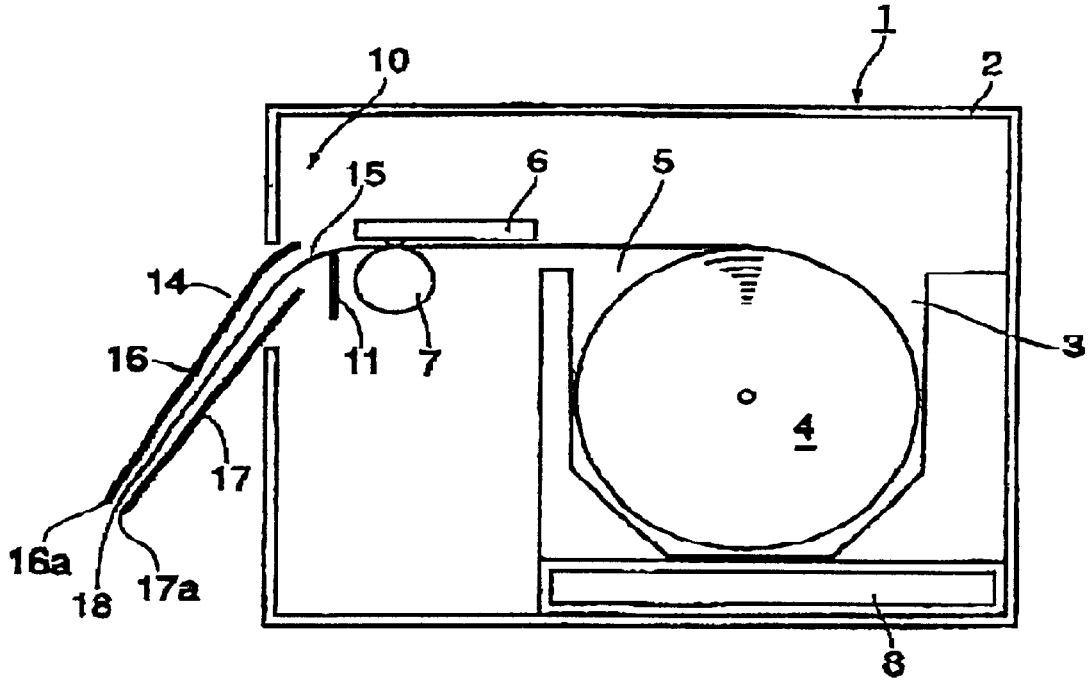
FIG. 1 is a sectional view showing a schematic arrangement of the main portions of a roll paper printer to which the present invention may be applied.
Figure 2:
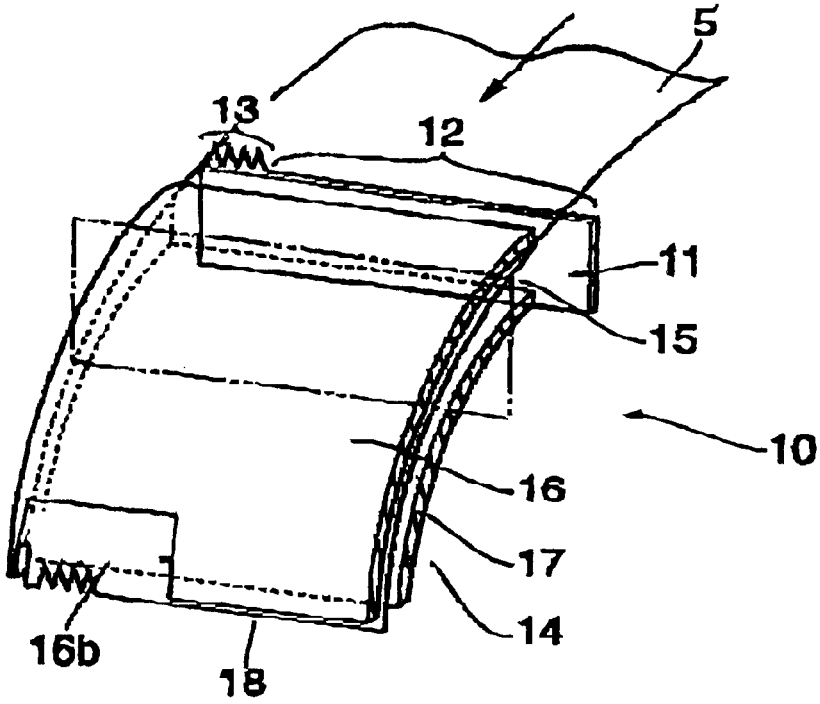
FIG. 2 shows a part of a cutter device according to an embodiment of the present invention.

FIG. 1 is a sectional view showing a schematic arrangement of the main portion of a roll paper printer as a type of a printer in which the recording paper cutter of an embodiment of the present invention is mounted, and FIG. 2 is a perspective view illustrating a recording paper guide and a cutting blade of the roll paper printer.

The roll paper printer 1 of the embodiment will be described with reference to FIGS. 1 and 2. The roll paper printer 1 includes a main body case 2 as a cabinet, a roll paper loading unit 3 formed in the main body case 2, a thermal head 6 for printing a roll paper 5 spooled out from a recording paper roll 4 loaded in the roll paper loading unit 3, and a platen roller 7 defining a print position of the thermal head 6. The drive of the thermal head 6 and the drive of a roll paper feeding mechanism (not shown) are controlled by a control unit 8 mounted below the roll paper loading unit 3. The thermal head 6, the platen roller 7, the roll paper loading unit 3, and a motor constitute basic elements of a print mechanism unit.

A recording paper cutter 10 is assembled in the roll paper printer 1 to cut the printed roll paper 5 to a predetermined length. The recording paper cutter 10 of the embodiment includes a cutting blade 11 and a recording paper guide 14. The cutting blade 11 is disposed downstream of the print position of the thermal head 6 in the feed direction of the roll paper. The blade edge of the cutting edge 11 is disposed in the width direction of the roll paper. Furthermore, the blade edge of the cutting blade 11 includes a linear blade edge 12, which extends in the width direction of the roll paper and is located at the same height, and a serrated blade edge 13 which is formed at an end of the linear blade edge 12, that is, at an end thereof in the width direction of the roll paper. The serrated blade edge 13 is composed of a plurality of serrations.

The recording paper guide 14 is disposed downstream of the cutting blade 11 in the feeding direction of the roll paper and is formed in a tapered beak-shape. The recording paper guide 14 has a recording paper inlet 15 opened downstream of the cutting blade 11. The recording paper guide 14 of the embodiment is composed of an upper guide 16, both sides of which are bent downward at a right angle, and a lower guide 17. A narrow rectangular paper discharge port 18 is formed by the extreme end edges 16*a* and 17*a* of the upper and lower guides 16 and 17.

An end of the extreme end edge 16*a* of the upper guide 16 is cut in the width direction of the roll paper by a predetermined width and length and is arranged as a cutout section 16*b* which is cut out upstream in the feeding direction of the roll paper. The end portion of the roll paper 5, the extreme end of which is fed up to a paper discharge port 18, can by simply held by an operator by the fingers through the cutout section 16*b* and be pulled toward the operator. The cutout section 16*b* is formed at a position corresponding to the serrated blade edge 13 in the width direction of the roll paper.

An operation for cutting the printed roll paper 5, which is to be discharged after it is printed, by the recording paper cutter 10 of the embodiment arranged as described above, and for dispensing it will be described. When the roll paper 5 is printed, the roll paper 5 is guided to the recording paper guide 14 passing past the cutting blade 11, and the roll paper 5 is then fed up to the roll paper discharge port 18 at the extreme end of the recording paper guide 14. Feeding of the roll paper 5 is then stopped. In this state, the portion, which corresponds to the cutout section 16*b* formed at the extreme end edge of the recording paper guide 14, of the extreme end portion of the roll paper 5 is exposed to the outside as shown in FIG. 2. Thus, this portion can be simply held by the fingers by the operator.

When this portion is held by the fingers and the roll paper is pulled toward the operator, the roll paper 5 is pulled downward using the blade edges 12 and 13 of the cutting blade 11 as fulcrums because the extreme end portion of the roll paper 5 is located at a position lower than the blade edges 12 and 13. The position where the roll paper 5 is pulled corresponds to the serrated blade edge 13 of the cutting blade 11, which causes the roll paper 5 to be pressed more firmly against the serrated blade edge 13 than against other portions. Accordingly, a side edge of the roll paper 5 is cut by the serrated blade edge 13 first, and then the roll sheet 5 is cut and is completely separated by the linear blade edge 12 along the width direction thereof with the side edge as the starting point of the cut so that a roll paper piece (e.g., a receipt) having a predetermined length can be obtained.

As described above, in the recording paper cutter 10 of the embodiment, the side edge of the roll paper 5 is cut by the serrated blade edge 13 first and the roll paper 5 is cut in the width direction with the side edge as the starting position of the cut. As a result, the roll paper can be very simply cut by exerting only a small operating force.

Note that the cutout section 16*b* may be formed at the lower guide 17 or at both the upper and lower guides 16 and 17. Furthermore, while the printer of the embodiment includes the thermal head, the present invention can of course be applied to any other kind of printer, including those with other types of printing head, for example, ones with an inkjet head.

Figure 3:
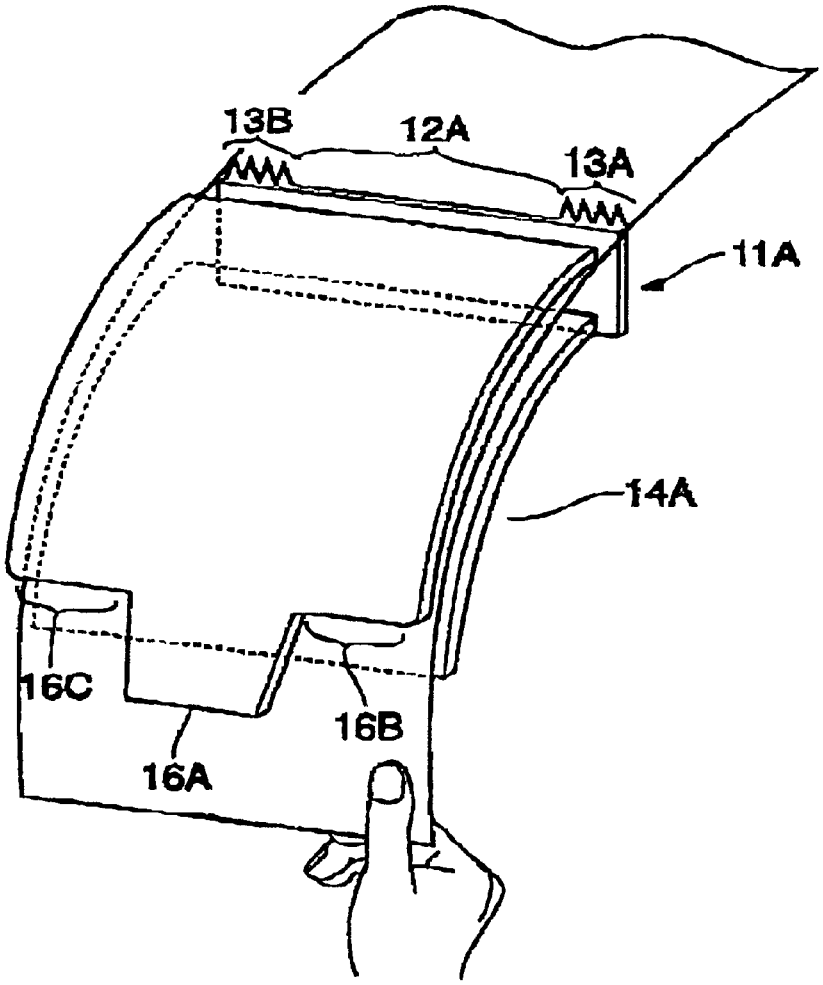
FIG. 3 shows a part of a cutter device according to another embodiment of the present invention.

Next, FIG. 3 shows modifications of the cutting blade 11 and the recording paper guide 14. In the modifications shown in FIG. 3, serrated blade edges 13A and 13B are formed on both ends of a linear blade edge 12A of a cutting blade 11A. Cutout sections 16*b* and 16C, which are cut out upstream in the feeding direction of the roll paper, are formed at both ends of the extreme end edge 16A of a paper discharge port of a recording paper guide 14A in correspondence with these serrated blade edges 13A and 13B.

In this case, the roll paper can be simply cut even if the extreme end of the roll paper is held and pulled toward an operator at either any side edge of the roll paper. That is, no matter whether the right or the left hand of the operator is used, the roll paper can be cut to the same level of cleanness.

Figure 4:
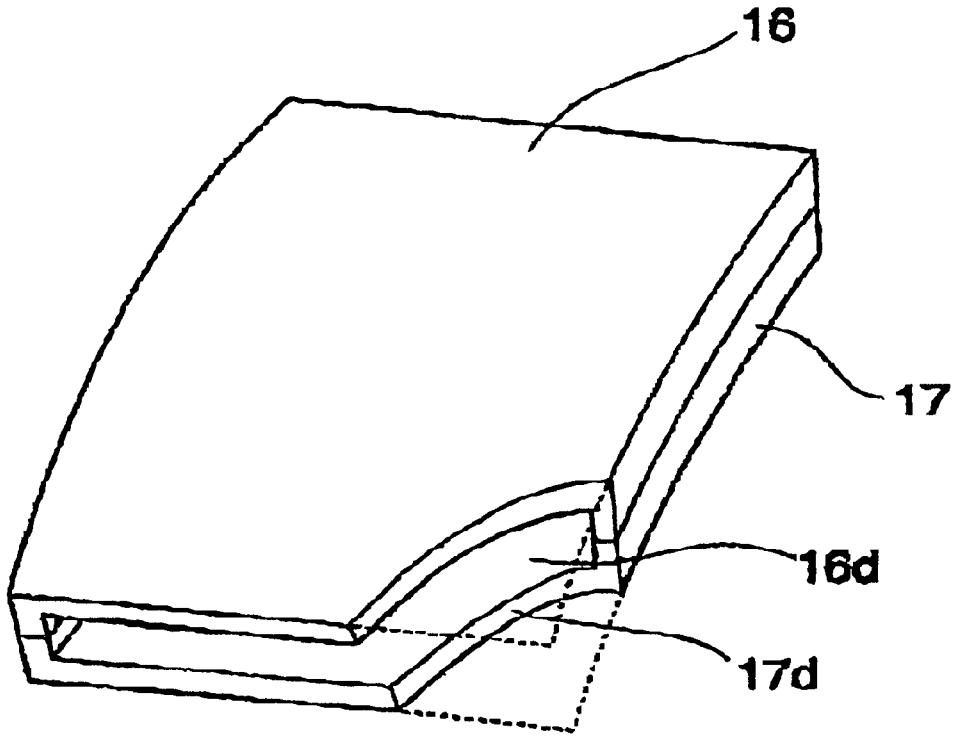
FIG. 4 shows a part of a cutter device according to another embodiment of the present invention.

FIG. 4 is a schematic view showing another modification of the recording paper guide 14. Cutout sections 16*d* and 17*d* are formed to both the upper and lower guides 16 and 17 of a paper discharge port so as to be arranged as a pair. Furthermore, although not shown, serrated blade edges are formed on the sides of a cutting blade which correspond to at least the above cutout sections 16*d* and 17*d*.

With this structure, even if the roll paper is fed by a small amount, the extreme end thereof can be easily grasped by the fingers, making it easier to take the roll paper.

Figure 5:
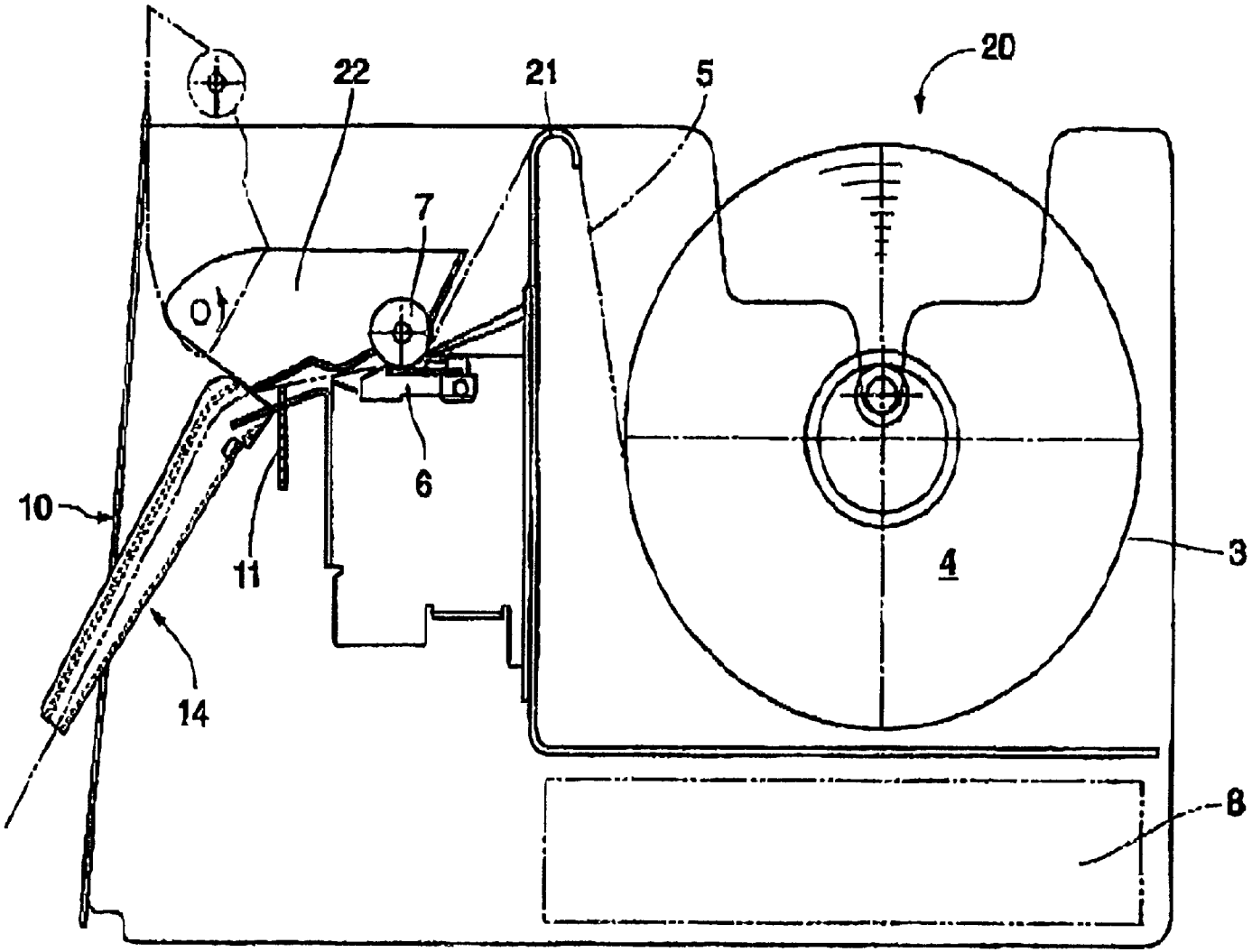
FIG. 5 is a view showing a schematic arrangement of the main portions of another roll paper printer to which the present invention may be applied.

Next, FIG. 5 shows another embodiment of a roll paper printer in which the recording paper cutter according to the present invention is mounted. The description of the recording paper cutter is omitted here because it is the same as for that shown in FIG. 1, and components in FIG. 5 that correspond to those in FIG. 1 are denoted by the same reference numerals as in FIG. 1.

The roll paper printer 20 of the embodiment is arranged such that a thermal head 6 facing upward is disposed under a roll paper 5 that is to be fed horizontally, and a platen roller 7 is disposed on the roll paper 5. As a result, the roll paper 5 is fed with the recording surface facing downward. In this state, the roll paper 5 is fed toward a recording paper cutter 10 while curled upward, and there is a possibility of a jam or the like occurring because the extreme end of the roll paper 5 is liable to be curled upward. To cope with this problem, an arc-shaped guide surface 21 is formed on a roll paper loading unit 3 to provide an inverted curl with the roll paper 5.

In the roll paper printer 20 of the embodiment, the platen roller 7 is disposed on the roll paper 5, and the platen roller 7 is mounted on a swing arm 22 at the extreme end thereof which is swingable upward and downward. When the swing arm 22 is swung from an operating position shown by a solid line in FIG. 5 to a retreating position shown by an imaginary line, a feed path of the roll paper from the print position thereof (position of the platen roller) to a recoding paper guide 14 can be placed in an open state. Accordingly, an advantage can be obtained in flat when a recording paper roll 4 is replaced, the operation for feeding the roll paper 5 through the path of the printer can be easily carried out by opening the feeding path.

As described above, the recording paper cutter of the present invention is arranged such that the cutting blade is composed of the linear blade edge, which extends in the width direction of a recording paper, and the serrated blade edge formed at an end of the linear blade edge, and the cutout section is formed at the extreme end edge, which is located below the serrated blade edge, of the recording paper guide on the discharge side thereof, so as to retract upward in the feeding direction of the recording paper so that the extreme end of the recording paper discharged from the recording paper guide can be held through the cutout section, and the cutout section is located at a position which corresponds to the serrated blade edge in the width direction of the recording paper.

According to the above arrangement, when an operator grasps the extreme end of the recording paper, which has a function of prompting him or her to grasp it and is exposed from the cutout section, and the operator pulls the extreme end toward him or her, a force acts on the edge of the recording paper, which is located on the serrated blade edge, to press the edge against the serrated blade edge. As a result, the edge is cut simply, and thus the recording paper is cut in the width direction thereof with the edge as a starting point. Thus, the recording paper can be cut simply by a small force.

Furthermore, by the function of the extreme end of the recording paper exposed from the cutout section as a prompt, even if the recording paper passes through the extreme end of the discharge port, it is expected that the passing of the paper will be understood by the operator to indicate that the extreme end of the paper should be grasped.

Furthermore, the provision of the cutout sections with the upper and lower recording paper guides as a pair permits the paper to be easily held at the extreme end thereof and to be more easily cut.

Furthermore, the provision of the cutout sections on both sides of the discharge port of the recording paper in the width direction thereof, and the provision of the serrated blade edges on both sides of the cutting blade or the provision thereof on the overall cutting blade, permit any operator to cut the recording paper to the same level of sharpness no matter the direction from which the operator grasps and pulls the paper, regardless of whether the operator is right-handed or left-handed.

The recording paper cutter described here may be assembled in a variety of receipt-issuing machines, such as one mounted on a gas pump point-of-sale (POS) terminal used in a gas station.

It will be apparent to those skilled in the art that various modifications and variations can be made in the recording paper cutter and printer device of the present invention without departing from the spirit or scope of the inventions. Thus, it is intended that the present invention cover modifications and variations of this invention that come within the scope of the appended claims and their equivalents.

What is claimed is:

1. A recording paper cutter comprising:

a recording paper guide for guiding a recording paper, the guide defining a discharge port at a downstream end in a feeding direction of the recording paper, the discharge port defining a cutout section on a side in a width direction of the recording paper to expose a portion of the recording paper discharged; and a recording paper cutting blade disposed upstream from the recording paper guide, the cutting blade having a linear blade edge extending in the width direction of the recording paper and a serrated blade edge formed at an end of the linear blade edge corresponding to the side where the cutout section of the discharge port is formed.

2. A recording paper cutter according to claim 1, wherein the discharge port defines another cutout section on another side in a width direction of the recording paper to expose another portion of the recording paper discharged; and wherein the cutting blade has another serrated blade edge formed on another end of the linear blade edge corresponding to the other side where the other cutout section of the discharge port is formed.

3. A recording paper cutter according to claim 1, wherein the recording paper guide includes a lower guide member and an upper guide member, and wherein the cutout section is formed in at least the upper guide member.

4. A recording paper cutter according to claim 3, wherein the cutout section is formed in both the upper and the lower guide member at positions facing each other.

5. A printer comprising a print mechanism unit;

a cabinet;

a recording paper guide for guiding a recording paper to an outside of the cabinet, the guide defining a discharge port at a downstream end in a feeding direction of the recording paper, the discharge port defining a cutout section on a side in a width direction of the recording paper to expose a portion of the recording paper discharged; and a recording paper cutter having a recording paper cutting blade disposed upstream from the recording paper guide, the cutting blade having a linear blade edge extending in the width direction of the recording paper and a serrated blade edge formed at an end of the linear blade edge corresponding to the side where the cutout section of the discharge port is formed.

6. A printer according to claim 5, wherein the discharge port defines another cutout section on another side in a width direction of the recording paper to expose another portion of the recording paper discharged; and wherein the cutting blade has another serrated blade edge formed on another end of the linear blade edge corresponding to the other side where the other cutout section of the discharge port is formed.

7. A printer according to claim 5, wherein the recording paper guide includes a lower guide member and an upper guide member, and wherein the cutout section is formed in at least the upper guide member.

8. A printer according to claim 7, wherein the cutout section is formed in both the upper and the lower guide member at positions facing each other.

9. A printer comprising:

an accommodating unit for accommodating a paper roll;

a print unit for printing the paper spooled out from the accommodating unit;

a feeding unit for feeding the paper printed by the print unit in a downstream direction by a predetermined length;

a guide unit disposed downstream from the feeding unit, the guide unit including two guide members and defining a discharge port, and guiding the paper on both guide members toward the discharge port, wherein a cutout section is formed in at least one guide member in the vicinity of the discharge port; and a cutter interposed between the guide unit and the feeding unit for cutting the printed paper, wherein the cutout section is formed at one side of the discharge port in the width direction of the paper, and wherein another cutout section is formed in at least one guide member in the vicinity of the discharge port, wherein the another cutout section is formed on another side of the discharge port in a width direction of the recording paper; and wherein the cutter has another serrated blade edge formed on a side that corresponds to the other side where the other cutout section is formed.

10. A method for cutting printed paper, comprising:

printing on a paper, feeding a predetermined length of the printed paper to an outlet to expose a first portion of the paper near a first side of the outlet in the width direction of the paper; and cutting the printed paper by contacting the paper with a cutter while pulling the paper at the first portion of the paper, wherein the cutter has a linear blade edge and a serrated blade edge on a side that corresponds to the side where a cutout section is formed.

11. A method according to claim 10, wherein the serrated blade edge is a first serrated blade edge formed at a first side of the cutter, and wherein the cutter has a second serrated blade edge formed near a second side of the outlet in the width direction of the paper, and wherein the step of feeding comprises feeding a predetermined length of the printed paper to an outlet to expose a first portion of the paper near the first side of the outlet in the width direction of the paper and a second portion of the paper near the second side of the outlet in the width direction of the paper, and wherein the step of cutting comprises cutting the printed paper by contacting the paper with at least one of the first and second serrated blade edges while pulling the paper at the first portion of the paper or the second portion of the paper.

12. A method for cutting printed paper, comprising:

printing on a paper, feeding a predetermined length of the printed paper to an outlet to expose a first portion of the paper near a first side of the outlet in the width direction of the paper; and cutting the printed paper by contacting the paper with a cutter while pulling the paper at the first portion of the paper, wherein the cutter has a linear blade edge and a serrated blade edge formed at a side of the cutter corresponding to the side where the portion of the paper is exposed.

13. A printer comprising:

an accommodating unit for accommodating a paper roll;

a print unit for printing on the paper spooled out from the accommodating unit;

a feeding unit for feeding the paper printed by the print unit in a downstream direction by a predetermined length;

a guide unit disposed downstream from the feeding unit, the guide unit including two guide members and defining a discharge port, and guiding the paper on both guide members toward the discharge port, wherein a cutout section is formed in at least one guide member in the vicinity of the discharge port; and a cutter interposed between the guide unit and the feeding unit for cutting the printed paper, wherein the cutout section is formed at one side of the discharge port in the width direction of the paper, and wherein the cutter has a linear blade edge and a serrated blade edge on a side that corresponds to the side where the cutout section is formed.

14. A printer according to claim 13, wherein the linear blade edge and the serrated blade edge are formed at a side of the cutter corresponding to the side where the portion of the paper is exposed.

* * * * *